US005743091A

United States Patent [19]

Penswick et al.

[11] Patent Number: 5,743,091

[45] Date of Patent: Apr. 28, 1998

[54] HEATER HEAD AND REGENERATOR ASSEMBLIES FOR THERMAL REGENERATIVE MACHINES

[75] Inventors: Laurence B. Penswick, Richland; Ray Erbeznik, Pasco, both of Wash.

[73] Assignee: Stirling Technology Company, Kennewick, Wash.

[21] Appl. No.: 637,923

[22] Filed: May 1, 1996

[51] Int. Cl.[6] ..... F01B 29/10

[52] U.S. Cl. ..... 60/517; 60/526

[58] Field of Search ..... 60/517, 520, 526

[56] References Cited

U.S. PATENT DOCUMENTS

| | | | |
|---|---|---|---|
| 4,527,394 | 7/1985 | Corey | 60/517 |
| 4,662,176 | 5/1987 | Fujiwara et al. | 60/526 |
| 5,315,190 | 5/1994 | Nasar | 310/12 |

FOREIGN PATENT DOCUMENTS

| | | | |
|---|---|---|---|
| 57-2447 | 1/1982 | Japan | 60/517 |

OTHER PUBLICATIONS

White, et al., "Generators that won't wear out," *Mechanical Engineering*, ASME Publication published Feb., 1996, pp. 92–96.

*Primary Examiner*—Noah P. Kamen

*Attorney, Agent, or Firm*—Wells, St. John, Roberts, Gregory & Matkin, P.S.

[57] ABSTRACT

A heater head for use with a thermal regenerative machine has a heater shell formed from a single piece of material. The shell has a tubular body with a cap-shaped end portion provided at a distal end and an open mouth portion provided at a proximal end. The heater head also has a mounting flange with a receiving portion configured to mate in fixed assembly with the open mouth portion of the heater shell. The mounting flange is constructed and arranged to mount the shell assembly to a housing of the thermal regenerative machine. The shell assembly and housing are hermetically sealed there between. Furthermore, a heater head for use with a thermal regenerative machine typically has a heater shell and a heat exchanger portion. The heat exchanger portion is formed substantially from a corrugated piece of sheet metal. The heat exchanger portion is affixed to an inner portion of the heater shell. The heater shell and heat exchanger portion cooperate to form a plurality of working gas flow paths having a large thermally conductive surface area.

35 Claims, 4 Drawing Sheets

HEATER HEAD AND REGENERATOR ASSEMBLIES FOR THERMAL REGENERATIVE MACHINES

TECHNICAL FIELD

This invention relates to thermal heat exchangers and more particularly to an improved heater head and regenerator assembly for thermal regenerative machines.

BACKGROUND OF THE INVENTION

Heater heads for thermal regenerative machines, particularly for ones being used with Stirling Cycle machines, are often subjected to high temperature environments for extended periods of time. Therefore, exotic materials having properties suitable for use in high temperature environments have been used to form heater heads. However, exotic materials are costly to use. Additionally, construction is costly since a large heat transfer surface area is usually required to be in contact with working gases that pass within the head.

A typical application for a heater head is found on a Stirling cycle electric power generator. One typical configuration has a movable displacer contained within an enclosed working chamber. The displacer forms a movable piston within the generator housing, transferring working fluid back and forth between a compression space (a low temperature space) and an expansion space (a high temperature space). A power extraction piston is provided in fluid communication with the compression space. Additionally, a fluid flow path transfers working fluid from the expansion space to the compression space through a gas heater, a regenerator, and a gas cooler, respectively. Heat is applied to the heater head, causing the displacer to reciprocate within a cylinder between the compression and expansion spaces. As a result, working fluid is transferred cyclically back and forth through the internal heat exchangers. The working gas is cooled as it flows through the gas cooler, adjacent to the compression space, and heated as it flows through the gas heater, adjacent to the expansion space. Depending on the direction of fluid flow, the regenerator acts as a heat exchanger that extracts heat from the gas passing from the gas heater to the gas cooler, and stores it for about one-half of an engine cycle. The stored heat is returned to the gas one-half cycle later as the gas flows from the gas cooler to the gas heater. External heat is supplied to the gas heater at the hot end where heat is applied by a source to the exterior of the heater head. Pressure oscillations in the compression chamber (low temperature space) cause the working piston of the linear alternator to reciprocate, creating a source of electrical power therefrom. In general, two heater head designs are used to transfer heat to the working fluid as it passes through the gas heater: a tubular head or a finned head.

For the case of a tubular heater head design, a plurality of tubes are brazed to the heater head. Such tubular designs are often used on designs for larger engines. However, when thermal movement of the tubes is restrained, the tubes can crack. Additionally, the large number of brazed connections needed to assemble these heater heads increases the likelihood of failure along a brazed joint. Furthermore, for applications using a high internal working gas pressure, in combination with thin walled tubes for facilitating improved wall conduction effects, severe limitations are placed on design requirements. Such designs have an increased likelihood of failing during operation.

For the case of a finned heater head design, a large amount of machining has been used to create fins along the inner surface of the heater head shell, or pressure wall. A large amount of scrap material is created during machining of an internally finned working gas heater surface. When combined with the need to use exotic materials during the construction of the heater head shell, the large amount of material wasted to machine fins greatly increases cost. Additionally, finned heater heads are favorably suited for applications that use an annular regenerator.

Both tubular and finned heater head designs use a combination of three different heat transfer processes. Convective and/or radiant heat transfer occurs from the external heating source to the walls of the tube or heater head cylinder surrounding the fins. Conductive heat transfer occurs through the walls of the tube or cylinder and fins. Convective heat transfer also occurs from the internal walls of the tube or fin into the adjacent working fluid. The relative contribution of each depends on the particular heater head construction being used.

The present invention arose from an effort to develop a heater head assembly having a heater head with a low cost and simplified construction, improved thermal transference from working gases passing therethrough, reduced amount of waste during manufacture, reduced flow resistance therethrough, and reduced use of exotic and expensive materials in construction. Furthermore, the present invention arose from an effort to develop an improved fabrication approach and method of assembly for a regenerator/stuffer assembly and a heater head.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of this invention, a heater head for use with a thermal regenerative machine has a heater shell formed from a single piece of material. The shell has a tubular body with a cap-shaped end portion provided at a distal end and an open mouth portion provided at a proximal end. The heater head also has a mounting flange with a receiving portion configured to mate in assembly with the open mouth portion of the heater shell. The mounting flange is constructed and arranged to mount the shell assembly to a housing of the thermal regenerative machine. Typically, the mounting flange is fabricated from a much lower cost material than the heater shell. Typically, the resulting shell assembly is brazed together to form an integral, hermetic assembly that can be manufactured for far less cost than if it were made from a single piece of material.

In accordance with another aspect of this invention, a heater head for use with a thermal regenerative machine has a heater shell and a heat exchanger portion. The heat exchanger portion is formed substantially from a corrugated piece of sheet metal. The heat exchanger portion is affixed to an inner portion of the heater shell. The heater shell and heat exchanger portion cooperate to form a plurality of working gas flow paths having a large thermally conductive surface area. In operation, the heat exchanger portion functions as a gas heater.

Figure 1:
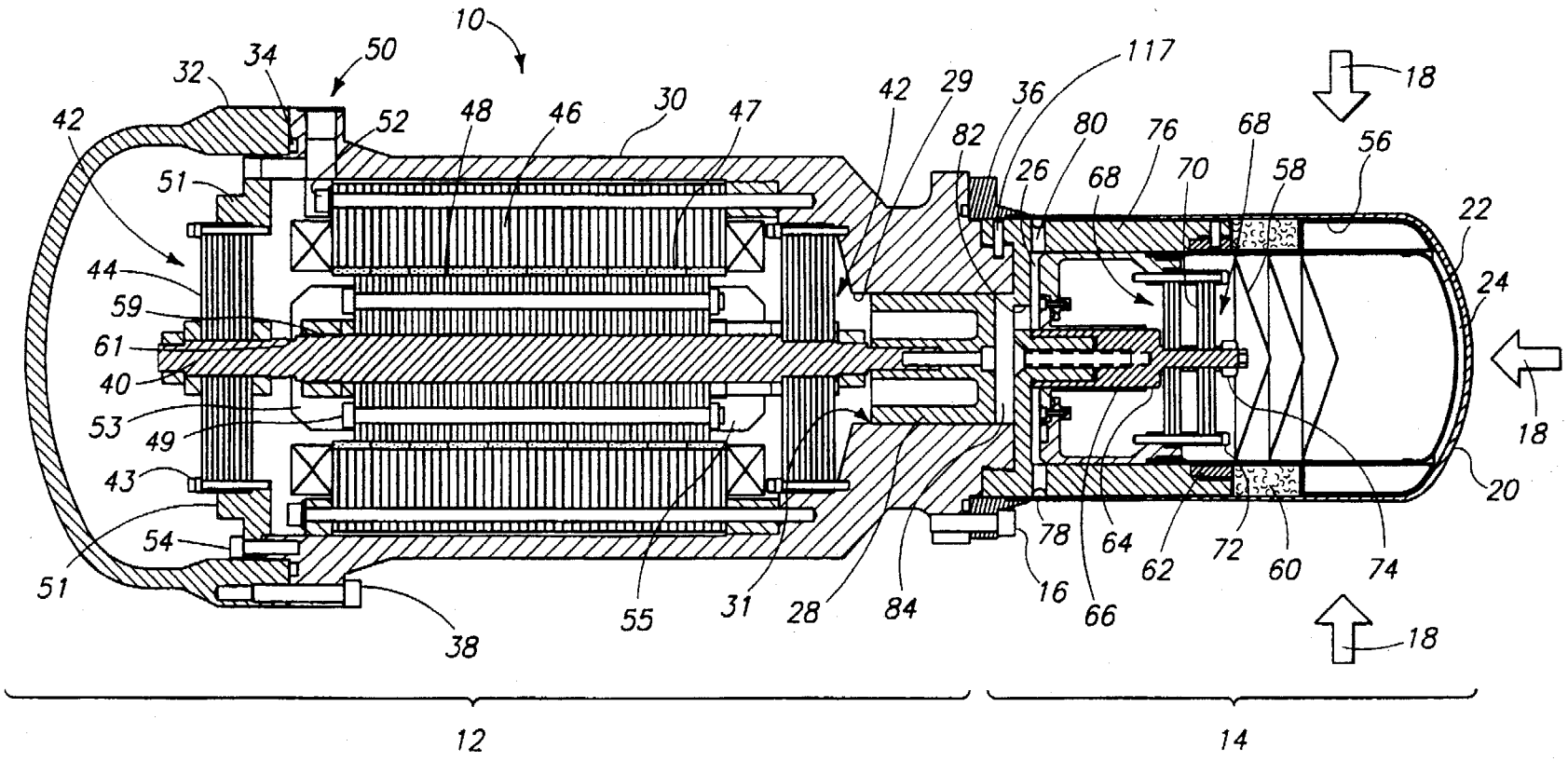
FIG. 1 is a vertical sectional view of a remote generator having a heater head and regenerator assembly embodying this invention.

A preferred embodiment of a Stirling power generator having an engine module assembly and a power module assembly referred to as a power generator is generally designated with reference numeral 10 in FIG. 1. Power generator 10 is formed by joining together a power module 12 and an engine module 14 with a plurality of circumferentially spaced apart threaded fasteners 16. The inside of power generator 10 is filled with a charge of pressurized thermodynamic working fluid such as Helium. Alternatively, hydrogen or any or a number of suitable thermodynamically optimal working fluids can be used to fill and charge generator 10. A heat source 18 applies heat to a heater head 20 of the engine module 14, causing power module 12 to generate a supply of electric power. A displacer assembly 22, comprising a movable displacer piston, forms a displacer that reciprocates between a hot space 24 and a cold space 26 in response to thermodynamic heating of the hot space from heater head 20 via heat source 18. In operation, displacer assembly 22 moves working gas between the hot and cold spaces 24 and 26. A power piston 28, suspended to freely reciprocate within power module 12 and in direct fluid communication with cold space 24, moves in response to pressure pulse variations within the cold space caused by reciprocation of displacer 22.

According to the device of FIG. 1, Stirling power generator 10 forms a remote or portable power generator. Alternatively, generator 10 can form a residential use generator, either for on-grid (power grid) or off-grid power applications. Further alternatively, although the preferred embodiment taught herein forms a piston-displacer type of engine, the same hot end assembly construction could be used with any of a number of similarly constructed engines, including a four-piston, Siemens-type engine which has no displacer.

A variety of different heat sources 18 can be used to drive the power generator 10 of FIG. 1. A fiber matrix burner that burns natural gas, propane, or some other flammable gas or fuel can be used to heat head 20. A cavity in the burner is shaped to receive head 20, transferring heat primarily by radiation to head 20. Such a burner construction is disclosed in Applicant's co-pending U.S. patent application Ser. No. 08/332,546, entitled "Hybrid Solar Power Receiver for Heat Engines", herein incorporated by reference. Alternatively, a more traditional convective burner fired by natural gas, propane, fossil or synthetic fuels, a solid biomass burner, a solar heater, or a nuclear fueled heat source could be used.

As depicted in FIG. 1, power module 12 includes a linear alternator that is driven by reciprocating motion of power piston 28 within a receiving bore 29 of a power module housing 30. A clearance seal 31 is formed between piston 28 and bore 29, enabling displacer induced pressure pulses to act on piston 28 via working fluid sealed within internal cavities of power generator 10. An end cap 32 mounts to an end of housing 30 with fasteners 38, enabling internal access when assembling and maintaining the alternator. A resilient elastomeric seal 34 is positioned between end cap 32 and housing 30, sealing them together under the compressive force of secured fasteners 38. Piston 28 is carried by an alternator shaft 40 in accurate axial reciprocation via a pair of flexure bearing assemblies 42. Each assembly is formed from a stack of flat spiral springs 44 retained along an outer periphery to housing 30, either directly, or indirectly via mounting ring 51. Details of such springs are disclosed in Applicant's co-pending U.S. patent application Ser. No. 08/105,156, entitled "Flexure Bearing Support, With Particular Application to Stirling Machines", herein incorporated by reference.

Construction details of the linear alternator of power module 12 are disclosed in Applicant's U.S. Pat. No. 5,315,190, entitled "Linear Electrodynamic Machine and Method of Using Same", herein incorporated by reference. An array of stationary iron laminations 46 are secured via a plurality of fasteners 52 within housing 30. The stationary laminations 46 form a plurality of spaced apart radially extending stationary outer stator lamination sets defining a plurality of stator poles, winding slots, and magnetic receiving slots. An array of annular shaped magnets 47 are bonded to the inner diameter of stationary laminations 46 for the purpose of producing magnetic flux. Each magnet 47 is received and mounted within the plurality of magnet receiving slots. Furthermore, the magnets have an axial polarity.

An array of moving iron laminations 48 are secured to shaft 40, such that the shaft and laminations move in reciprocating motion along with piston 28. A plurality of threaded fasteners 49 are received through radially spaced apart through holes in each lamination 48, trapping the laminations 48 between retaining collars 53 and 55 carried on shaft 40. Collar 53 is axially secured onto shaft 40 with threads 59 where it also seats against a shoulder 61. Relative motion between moving laminations 48 and stationary laminations 46 produces electrical power that is output through a power feed 50. To facilitate assembly of the alternator, a mounting ring 51 is used to support shaft 40 by means of an accompanying one of flexure bearing assemblies 42 opposite piston 28. A plurality of fasteners 54 are used to retain ring 51 to housing 30.

Figure 2:
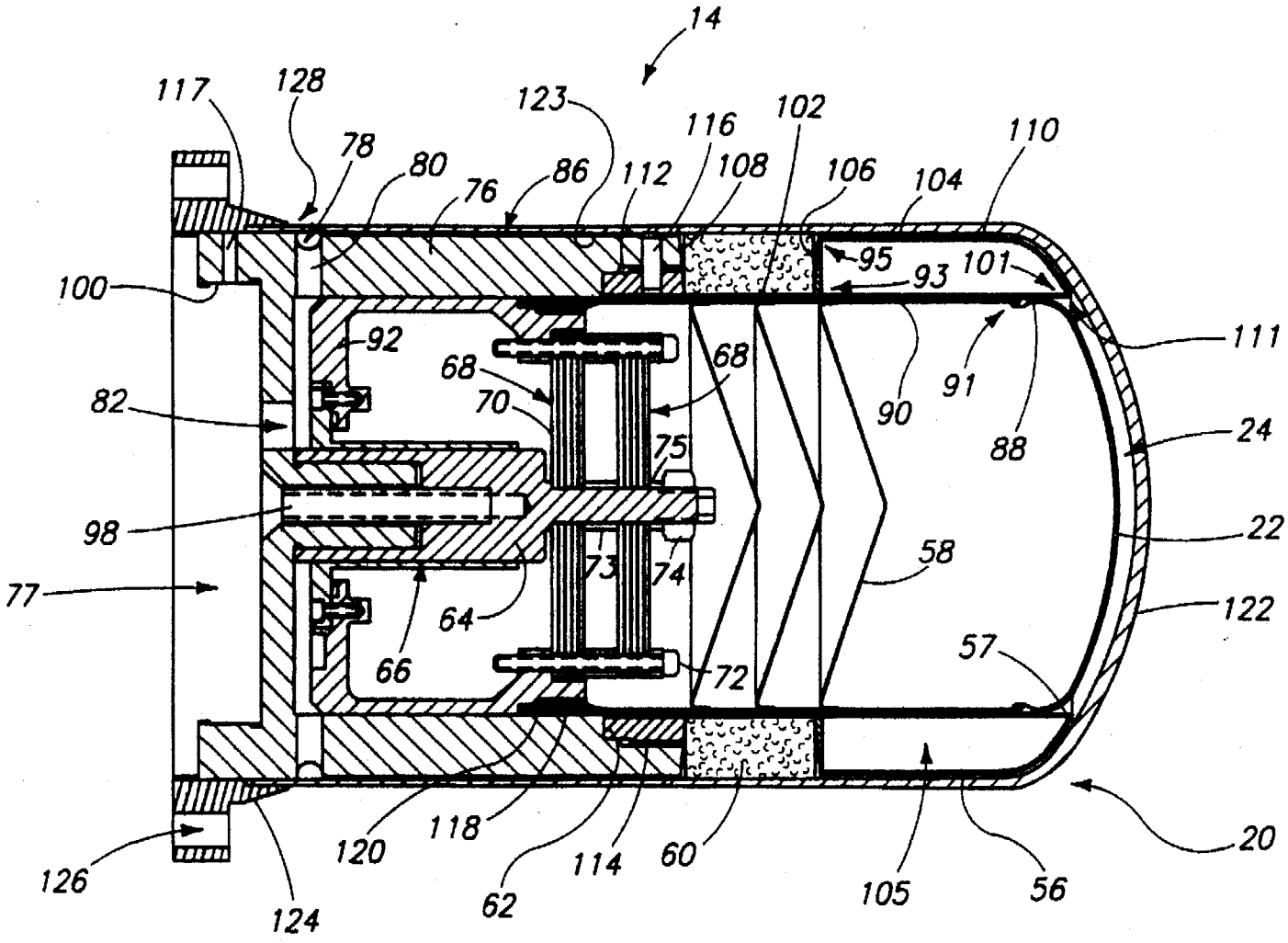
FIG. 2 is an enlarged vertical sectional view of the heater head and regenerator assembly of FIG. 1.

Referring to FIGS. 1 and 2, stuffer assembly 56 is securely fitted within heater head 20 to direct the flow of working gas between hot space 24 and cold space 26 through heat exchanger 110. Movement of displacer 22 reciprocating within engine module 14 causes the flow of working gas there between. Additionally, a receiving bore 57 is formed by assembly 56 inside of which displacer 22 reciprocates with a clearance seal formed there between. A plurality of thermal radiation shields 58 are also provided within displacer 22 in order to improve the capture of radiant heat energy within hot space 24 being applied by burner 18. A regenerator 60, carried by stuffer assembly 56, provides heat storage for fluid flowing in one direction and heat recovery for fluid flowing in the opposite direction. A threaded ring 62 is received on stuffer assembly 56, trapping regenerator 60 on assembly 56. Ring 62 is used to mount assembly 56 within engine module 14. Ring 62 is affixed to assembly 56 by applying a thin layer of 2214 Scotch-Weld Hi-Flex epoxy adhesive to a recessed portion along an inner diameter of ring 62, then assembling the ring to the assembly. Alternatively, other suitable adhesives or fastening techniques can be used.

In one embodiment, regenerator 60 is formed from "316L" stainless steel wire having a thickness of 22 microns.

The wire forms a random fiber with "300" mesh that is sintered together. The sintered wire regenerator 60 is formed in the shape of a ring, with an outer diameter of about 3.99 inches, inner diameter of about 3.08 inches, and thickness of about 0.947 inches. Various alternative sizes and constructions can be used to form regenerator 60.

According to FIG. 2, mounting post 64 movably supports displacer 22 via a pair of flexure bearing assemblies 68. Post 64 is provided in a stationary location within engine module 14. Displacer assembly 22 forms a clearance seal 66 along post 64, eliminating any contact friction there along. Each assembly 68 is formed from a stack of flat spiral steel springs 70. Each stack of springs is securely retained to displacer assembly 22 along an outer periphery via a plurality of threaded fasteners 72. The central portion of each spring 70 is retained to a shaft portion of post 64 via a retaining nut 74. Nut 74 and post 64 cooperate with cylindrical spacers 73 and 75 to secure the inner portion of flexure bearing assemblies 68 at stationary locations to a cooler housing 76, and in relative spaced apart relation there between.

Referring in more detail to FIG. 2, cooler housing 76 is securely affixed to stuffer assembly 56 and regenerator 60 via ring 62. Housing 76 is formed from a single piece of aluminum, with a cylindrical main body and a spider-shaped end portion 77. Housing 76, stuffer assembly 56, regenerator 60 and ring 62 are then received within heater head 20 where they are rigidly affixed together according to an assembly technique discussed below. Housing 76 has a circumferential groove 78 formed along an outermost portion for transferring working gas from a fluid flow path 86 through a plurality of radially extending ports 80, and into cold space 26. A plurality of circumferentially spaced apart axial ports 82 formed in the spider of housing 76 place cold space 26 in direct fluid communication with a working chamber 84 (see FIG. 1) when assembled. In this manner, housing 76 directs working fluid between regenerator 60 and cold space 26.

More particularly, working gas is transferred between regenerator 60 and cold space 26 through an outer circumferential gas flow passage formed substantially along the inner surface 123 of heater head 20. Pressure variations produced in cold space 24 from movement of displacer 22 act on piston 28 (of FIG. 1) via ports 82 to produce a supply of electrical power. Radial ports 80 and groove 78 communicate with a circumferential flow path 86. Path 86 is formed between an outer diameter of housing 76 and inner surface 123 of heater head 20. An outer end of housing 76 and ring 62 form a bevel 108 that allows fluid communication between path 86 and regenerator 60. A similar bevel is formed by a ring 106 used to construct stuffer assembly 56. Such a bevel enables fluid communication between regenerator 60 and a flow path 111 formed between assembly 56 and heater head 20. Path 111 communicates directly with hot space 24, and also contains heat exchanger features provided by a corrugated heat exchanger 110 as discussed below.

Displacer assembly 22 of FIG. 2 is formed from a multiple piece construction. A cap 88 (formed from Inconel "718") is attached to a displacer tube 90 (formed from stainless steel) with a brazed joint 91. Tube 90 is mounted via threads 118 to a tubular chassis 92. A tubular shaped clearance seal member 94 is mounted to a flange of chassis 92 via a plurality of fasteners 96. Member 94 is sized and located in relation to post 64 to produce clearance seal 66. Additionally, a circumferential seal 97 is seated by fasteners 96 between chassis 92 and member 94. The multiple piece construction of displacer 22 facilitates its assembly and maintenance.

In order to mount displacer 22 inside of engine module 14, chassis 92 and member 94 are first secured together as shown in FIG. 2. Flexure assemblies 68 are then used to attach chassis 92 to post 64. Next, post 64 is secured to spider 77 of housing 76 with fastener 98. Subsequently, a pre-assembled arrangement of tube 90, cap 88, and shields 58 are threaded onto chassis 92. A resilient elastomeric seal 120 in combination with threads 118 ensure a sealed attachment between chassis 92 and tube 90. Post 64 is removably mounted to spider 77 of housing 76 via a threaded fastener 98 in order to facilitate assembly and maintenance. A pre-assembled arrangement of ring 62, regenerator 60 and stuffer assembly 56 are then received over displacer 22 and attached to housing 76 via threads 114 and o-ring seal 112. A threaded retaining pin 116 prevents unthreading of ring 62 from housing 76. A radial inner portion of housing 76 forms threads to facilitate mounting of the assembled housing 76 to housing 30. Another threaded retaining pin 117 prevents unthreading of housing 76 from housing 30 of power module 12 (see FIG. 1).

Figure 3:
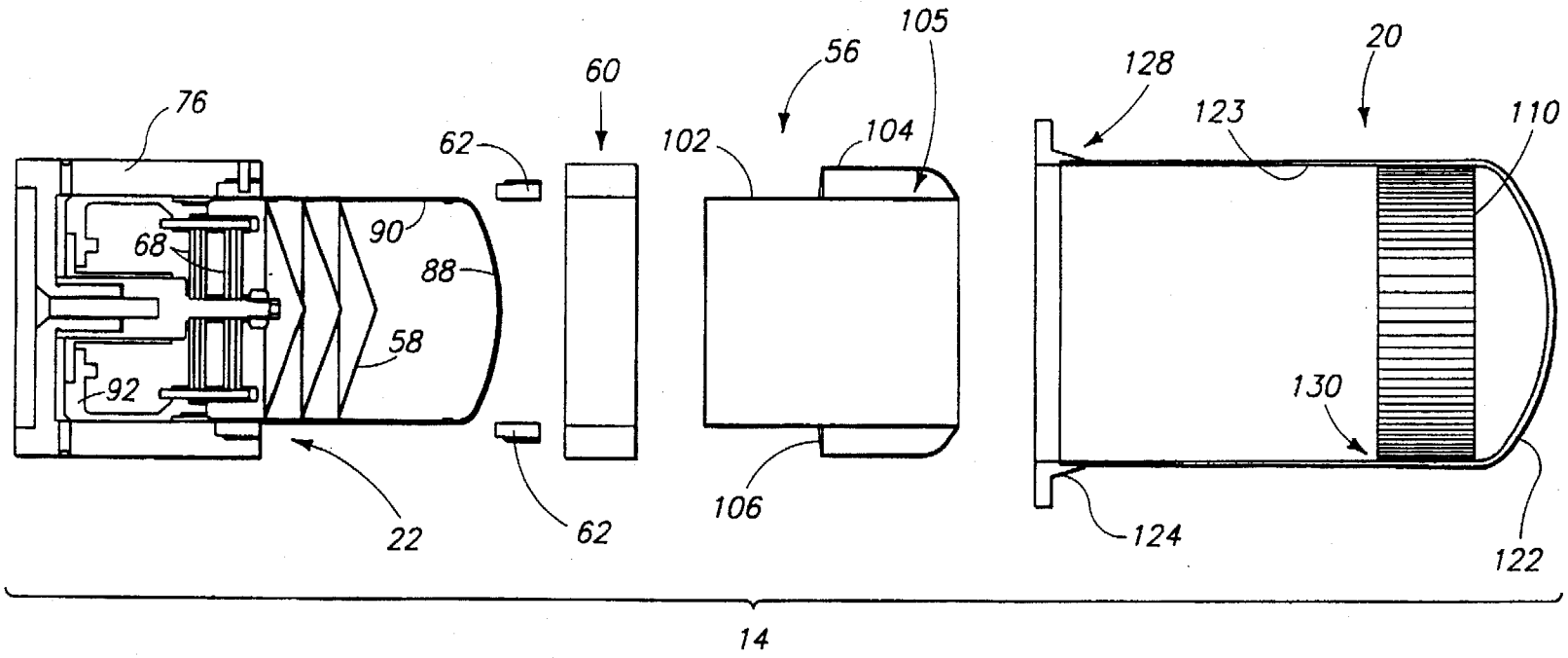
FIG. 3 is an exploded vertical sectional view of the heater head and regenerator assembly of FIG. 2.

Stuffer assembly 56 of FIG. 2 is formed from a stainless steel stuffer tube 102 that forms a cylinder bore for receiving displacer 22. Bevel-shaped stainless steel ring 106 is attached with a braze joint 93 to an outer surface of tube 102, and an outer shell 104, also of stainless steel, is attached with braze joints 95 and 101 at either end to ring 106 and tube 102, respectively. As shown in FIG. 3, a sealed chamber 105 is formed between tube 102, ring 106, and shell 104 that greatly reduces the dead volume of working gas within the engine module. Additionally, an outer surface of shell 104 guides working gas through a corrugated heat exchanger 110 that is brazed to the inner surface 123 of heater head 20.

As shown in FIG. 3, heater head 20 is formed from a hot end heater shell 122 that is secured to a mounting flange 124 via a braze joint 128. Additionally, corrugated heat exchanger 110 is secured to inner surface 123 of shell 122 via braze joints 130. Stuffer assembly 56 is first assembled to regenerator 60 and ring 62, and then to housing 76 (supporting displacer 22), via ring 62. Heater head 20 is then inserted over assembly 56, preferably after head 20 has been heated several hundred degrees Celsius, after which head 20 cools and shrink fits over regenerator 60. Alternatively, stuffer assembly 56 and regenerator 60 can be press fit or slip fit into heater head 20. The purpose of such assembly steps is to ensure a close fit between the outer diameter of regenerator 60 and inner surface 123 of heater head 20 to avoid regenerator blow-by. Assembly 56, regenerator 60, ring 62, housing 76, and displacer 22 are already assembled together prior to fitting heater head 20 there over. Upon assembly of heater head 20, a plurality of fastener receiving holes 126 in flange 124 receive fasteners 16 (see FIG. 1) to secure head 20 to the power module housing 30.

Figure 4:
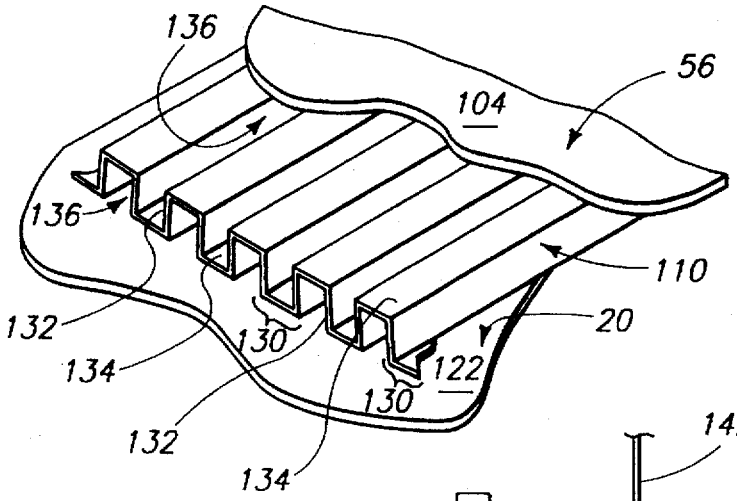
FIG. 4 is an enlarged partial perspective view of the corrugated fin structure in the heater head.

FIG. 4 illustrates a breakaway portion of the heat exchanger construction of this invention pursuant to the device of FIGS. 1–3. Corrugated heat exchanger 110 is secured to shell 122 with a plurality of braze joints 130, one formed along each flat surface 134. Portions of exchanger 110 extending perpendicular to surfaces 134 form thermally conductive fins 132. A flow channel 136 is formed between each adjacent fin 132, a flat 134, and one of shell 104 or shell 122. Working gas being moved between hot space 24 and regenerator 60 is exposed to a large thermally conductive surface area via exchanger 110, acting in concert with adjacent wall 122. Therefore, a large amount of heat applied through heater head 20 via source 18 is transferred to the working gas. Additionally, such a construction for exchanger 110 greatly reduces machining and use of exotic materials, such as Inconel "718", which is used to construct shell 122. Exchanger 110, on the other hand, is formed from Nickel "201". Furthermore, flange 124 is formed from stainless steel, and is brazed to shell 122.

As shown in FIGS. 3 and 4, corrugated heat exchanger 110 in assembly is sandwiched between shell 104 of stuffer assembly 56 and hot end heater shell 122 of heater head 20. In one embodiment, the heat exchanger 110 is formed from a thin sheet metal web 142 (see FIG. 5) of Nickel "201" material. One suitable construction uses a web having a width in the flow direction of 1.33 inches and a thickness of 0.004 inches, with a corrugated thickness of exchanger 110 of 0.03 inches, and a face width 134 along braze joint 130 of 0.026 inches. Various alternative constructions are also envisioned.

Figure 5:
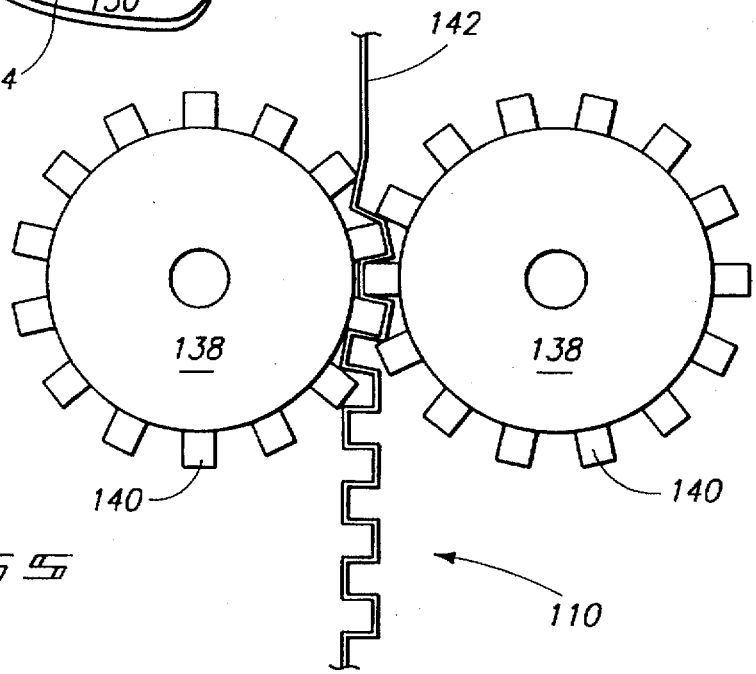
FIG. 5 is a simplified schematic view of a forming process for the corrugated fin structure in the heater head of FIGS. 1–3.

FIG. 5 illustrates the formation of heat exchanger 110 from web of sheet metal 142. Sheet metal web 142 is fed between a pair of forming wheels 138, each having a circumferentially space-apart array of gear teeth 140. Wheels 138 are driven in gear-meshed rotation as sheet metal web 142 is fed there between. Accordingly, teeth 140 corrugate sheet metal web 142 to form exchanger 110. Alternatively, various other stamping, corrugating, fixturing, and assembling techniques can be used to form exchanger 110 with rectangular, or square, corrugations. Furthermore, a variety of alternative cross-sectional corrugation configurations can be imparted to sheet metal web 142, other than rectangular. For example, a sinusoidal or triangular configuration can be formed in sheet metal web 142.

Figure 6:
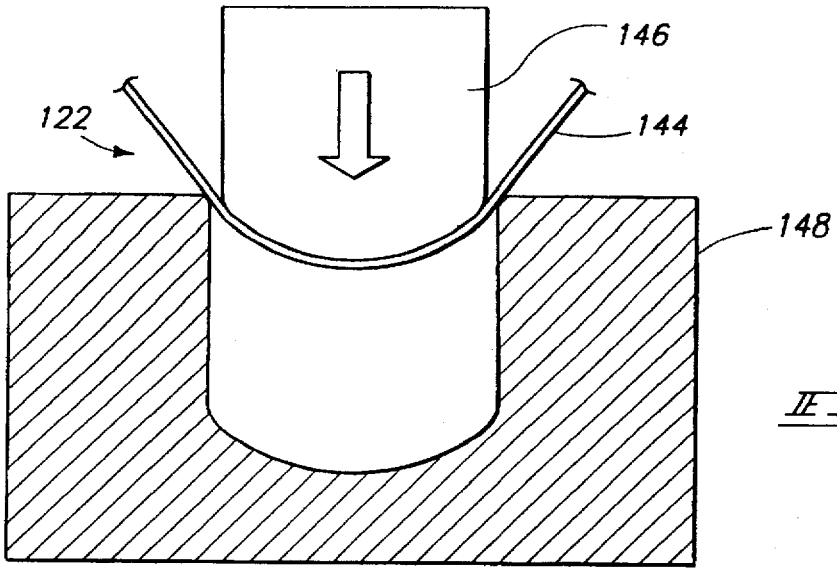
FIG. 6 is a schematic view of a deep-draw fabrication step used to form the heater shell of the heater head of FIGS. 1–3.

FIG. 6 illustrates the formation of hot end heater shell 122 from a blank of Inconel "718" sheet metal material. Inconel "718" is used due to its substantial thermal resistance when exposed to heat. Similarly, Inconel "718" is used to construct the displacer cap 88 (of FIG. 2) for the same reason. Inconel "718" is one of a number of suitable high strength, corrosion resistant alloys that exhibit an ability to retain high strength when exposed to temperature levels suitable for Stirling engines. Alternatively, any of a number of such alloys can be used. Blank 144 consists of a flat sheet of metal that is formed by a typical fabrication sequence of: deep-draw, anneal, deep-draw, anneal, roll-form, and anneal. A first deep draw operation is depicted in FIG. 6 where blank 144 is formed between a ram 146 and a die 148 to impart the beginning of a bowl-shaped head to the end of the heater head shell. The head can be formed into any of a number of shell shapes including spherical or segments of modified spherical shapes, as well as any other suitable geometric configuration. For example, any of a number of shell shapes having the form of a surface of revolution can be used to form the head.

Following the fabrication sequence, shell 122 of FIG. 2 is relatively thick along the region of the bowl-shaped head. Shell 122 then tapers, or thins out, from the head toward regenerator 60. Shell 122 has a relatively constant material thickness from regenerator 60 to flange 124. One suitable construction of shell 122 calls for an inner diameter of 3.995 inches, a bowl-shaped head thickness of 0.080 inches, and a wall thickness of 0.045 inches between regenerator 60 and flange 124. Various other alternative constructions are also envisioned.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A heater head for use with a thermal regenerative machine, comprising:

a heater shell having a smooth outer surface configured to radiantly couple with an external heat source, the heater shell having a tubular body comprising a single piece of material having a cap-shaped end portion at a distal end and an open mouth portion at a proximal end; and a mounting flange having a receiving portion configured to mate in assembly with the open mouth portion of the heater shell, the mounting flange constructed and arranged to mount the heater head to a housing of a thermal regenerative machine.

2. The heater head of claim 1 wherein the thermal regenerative machine is a Stirling engine, and the heater head forms a hot end of the Stirling engine.

3. The heater head of claim 1 wherein the heater shell is formed from temperature resistant metal.

4. The heater head of claim 3 wherein the heater shell is Inconel.

5. The heater head of claim 1 further comprising a heat exchanger portion formed substantially from a corrugated piece of sheet metal, the heat exchanger portion constructed and arranged to mate in assembly with an inner surface of the heater shell.

6. The heater head of claim 5 wherein the heater shell and heat exchanger portion cooperate to form a plurality of working gas flow paths having a large thermally conductive surface area.

7. The heater head of claim 5 wherein the heat exchanger portion is brazed to the inner surface of the heater shell.

8. The heater head of claim 5 wherein the corrugated sheet metal has a rectangular cross-sectional configuration.

9. The heater head of claim 1 wherein the heater shell comprises a single piece of formed sheet metal.

10. The heater head of claim 1 wherein the heater shell comprises a bowl-shaped head portion and a cylindrical portion.

11. The heater head of claim 10 wherein the head portion is at least as thick as the cylindrical portion.

12. The heater head of claim 11 wherein at least a portion of the cylindrical portion is thinner than the head portion.

13. The heater head of claim 10 wherein the cylindrical portion reduces in thickness in a direction extending away from the bowl-shaped head portion.

14. A heater head for use with a thermal regenerative machine, comprising:

a heater shell having a smooth outer surface configured to radiantly couple with an external heat source comprising a cap-shaped head and a tubular side wall extending from the head toward an open mouth portion opposite the head, the head comprising a thickened conductive portion and the tubular side wall comprising a thinned, tapered wall portion having a reduced wall thickness extending away from the head; and a heat exchanger portion formed substantially from a corrugated piece of sheet metal, the heat exchanger portion affixed to an inner surface of the heater shell, and the heater shell and heat exchanger portion cooperating to form a plurality of working gas flow paths having a large thermally conductive surface area.

15. The heater head of claim 14 wherein the heater shell is formed at least in part from temperature resistant material.

16. The heater head of claim 14 wherein the heater shell comprises a tubular body with a cap-shaped end portion at a distal end and an open mouth portion at a proximal end.

17. The heater head of claim 16 wherein the heat exchanger portion is provided adjacent the cap-shaped end portion.

18. The heater head of claim 16 wherein the heater shell comprises a piece of temperature resistant material.

19. The heater head of claim 18 wherein the heater shell is formed from Inconel.

20. The heater head of claim 14 further comprising a mounting flange having a receiving portion configured to mate in assembly with the open mouth portion of the heater shell, the mounting flange constructed and arranged to mount the shell assembly to a housing of the thermal regenerative machine.

21. The heater head of claim 14 wherein the heat exchanger portion comprises a plurality of fins extending substantially radially inwardly of the heater shell.

22. The heater head of claim 21 wherein a flow channel is provided between each adjacent pair of fins, in operation, working fluid flowing through the channel in fluid communication with each adjacent fin.

23. A thermodynamic machine, comprising:

an alternator having a power piston; and an engine having a displacer, a regenerator assembly, and a heater head, the heater head comprising a heater shell formed from conductive sheet metal having a smooth outer surface configured to radiantly couple with an external heat source comprising a cap-shaped head and a tubular side wall extending from the head, the heater shell comprising a thickened wall portion and the tubular side wall comprising a reduced wall thickness portion extending away from the head, and a heat exchanger portion formed substantially from a corrugated piece of thermally conductive sheet material, the heat exchanger portion affixed to an inner portion of the heater shell, and the heater shell and heat exchanger portion cooperating to form a plurality of working gas flow paths having a large thermally conductive surface area.

24. The machine of claim 23 wherein the thermally conductive sheet material is sheet metal.

25. The machine of claim 23 wherein the thermally conductive sheet material is Inconel.

26. The machine of claim 23 further comprising a mounting flange having a receiving portion configured to mate in assembly with the open mouth portion of the heater shell, the mounting flange constructed and arranged to mount the shell assembly to a housing of the thermodynamic machine.

27. The machine of claim 23 wherein the alternator comprises a linear electric alternator that produces alternating current.

28. The machine of claim 23 wherein the heater shell is formed from a single piece of material having a tubular body with a cap-shaped end portion at a distal end and an open mouth portion at a proximal end.

29. The machine of claim 28 wherein the heater shell comprises a bowl-shaped head portion and a cylindrical portion.

30. The machine of claim 28 further comprising a mounting flange having a receiving portion configured to mate in assembly with the open mouth portion of the heater shell, the mounting flange constructed and arranged to mount the shell assembly to a housing of the thermodynamic machine.

31. A displacer module of a thermodynamic machine, comprising:

a heater head comprising a heater shell having a smooth outer surface configured to radiantly couple with a heat source;

a regenerator constructed as a cylindrical member, sized to be received within an inner surface of the heater head, and disposed within a working fluid flow path when assembled therein; and a stuffer assembly having a tube and an outer shell, the stuffer assembly sized to receive and retain the regenerator about the tube adjacent the outer shell;

the stuffer assembly and regenerator being received in assembly within the heater head.

32. The module of claim 31 further comprising a threaded ring also received about the tube adjacent the regenerator, the ring constructed and arranged to mate the stuffer assembly with a housing of the heater head.

33. The module of claim 31 wherein the stuffer assembly is self-fixtured and brazed together.

34. The module of claim 31 wherein the heater head is locked into place over the regenerator by heating the heater head to expand it, then cooling it when assembled.

35. The module of claim 31 wherein the heater head is removably assembled into place over the regenerator by dimensioning the heater head to fit over the assembly, but maintain a close fit with the regenerator to minimize blow-by.

* * * * *

UNITED STATES PATENT AND TRADEMARK OFFICE

CERTIFICATE OF CORRECTION

PATENT NO. : 5,743,091

DATED : April 28, 1998

INVENTOR(S) : Laurence B. Penswick and Raymond M. Erbeznik

It is certified that error appears in the above-identified patent and that said Letters Patent is hereby corrected as shown below:

Col. 7, line 19: Delete "space-apart" and insert --spaced-apart--.

Col. 10, line 44 (next to last line), Claim 35: Delete "maintain" and insert --maintaining--.

Signed and Sealed this

Fourteenth Day of July, 1998

Bruce Lehman

*Attest:*

BRUCE LEHMAN

*Attesting Officer*

*Commissioner of Patents and Trademarks*